US005633622A

United States Patent [19]

Patterson

[11] Patent Number: 5,633,622

[45] Date of Patent: May 27, 1997

[54] TRUCK DRIVER LOGGING DEVICE DISPLAYING A TIME LOG GRAPH

[76] Inventor: Robert L. Patterson, 14010 Hilldale Rd., Valley Center, Calif. 92082

[21] Appl. No.: 616,156

[22] Filed: Mar. 14, 1996

[51] Int. Cl.[6] ..... G08B 1/08

[52] U.S. Cl. ..... 340/309.15; 340/439; 364/424.04

[58] Field of Search ..... 340/309.15, 438, 340/439, 425.5; 364/424.04, 424.03, 424.01

[56] References Cited

U.S. PATENT DOCUMENTS 5,184,303 2/1993 Link ..... 364/449
5,274,561 12/1993 Adams ..... 364/467

*Primary Examiner*—Jeffery Hofsass
*Assistant Examiner*—Anh La

[57] ABSTRACT

A truck driver logging device including a display adapted to depict a time log graph. The time log graph comprises a plurality of rows each corresponding to a duty pertinent to the daily activities of a truck driver. The time log graph further comprises a multiplicity of columns with vertically aligned tick marks depicted thereon. Each tick mark corresponds to a specific time within a twenty-four hour period. A plurality of duty buttons are adapted to graph a line within the corresponding row between two of the tick marks thus displaying the specific time of the day allotted to the corresponding duty. The beginning of a specific line in a row is defined merely by pressing duty key at the beginning of the time allotted to the associated duty and the end thereof is afforded by the subsequent depression of a different duty key. A control mechanism is adapted to automatically calculate and display the time graphically depicted for each duty and further to automatically calculate and display a running weekly total of time entered during a present week for each duty.

13 Claims, 5 Drawing Sheets

TRUCK DRIVER LOGGING DEVICE DISPLAYING A TIME LOG GRAPH

BACKGROUND OF THE INVENTION

1. Field of the Invention

The present invention relates to a trucker driver logging device and more particularly pertains to an electronic device for allowing a truck driver to conveniently keep a daily log with minimal keystrokes.

2. Description of the Prior Art

The use of log devices is known in the prior art. More specifically, log devices heretofore devised and utilized for the purpose of maintaining a database are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,916,827 to Rayburn a flat, roller-like guide shaped to be laid over the tables and scales set forth in a trucker's log book. U.S. Pat. No. 4,854,048 to Goulet discloses a template for a driver's log book. U.S. Pat. No. 5,122,959 to Nathanson et al. discloses a transportation dispatch and delivery tracking system. U.S. Pat. No. 3,974,568 to Linderman; U.S. Pat. No. 4,611,406 to Engstrom et al.; U.S. Pat. No. 5,184,303 to Link; and U.S. Pat. No. 4,092,718 to Wendt are provided as being of general interest.

In this respect, the trucker driver logging device according to the present invention substantially departs from the conventional concepts and designs of the prior art, and in so doing provides an apparatus primarily developed for the purpose of allowing a truck driver to conveniently keep a daily log with minimal keystrokes.

Therefore, it can be appreciated that there exists a continuing need for a new and improved trucker driver logging device which can be used for allowing a truck driver to conveniently keep a daily log with minimal keystrokes. In this regard, the present invention substantially fulfills this need.

SUMMARY OF THE INVENTION

In view of the foregoing disadvantages inherent in the known types of log devices now present in the prior art, the present invention provides an improved trucker driver logging device. As such, the general purpose of the present invention, which will be described subsequently in greater detail, is to provide a new and improved trucker driver logging device which has all the advantages of the prior art and none of the disadvantages.

To attain this, the present invention essentially comprises a compact housing having a lower portion with a top surface, a bottom surface, and a periphery formed therebetween defining an interior space. An upper portion with a top surface, a bottom surface, and a periphery is hingably coupled to a rear extent of the lower portion for allowing the housing to be orientated in either a closed or open configuration. Also included is a display situated on the bottom surface of the upper portion. The display is adapted to depict data pertinent to the duties of a truck driver and further to display a time log graph. The time log graph comprises a plurality of rows which include an off duty row for graphically displaying a time allotted to being off duty, a sleeper berth row for graphically displaying a time allotted to bathing and sleeping, a driving row for graphically displaying a time allotted to driving, an on duty row for graphically displaying a time allotted to not driving, and a miscellaneous row for graphically displaying a time allotted to miscellaneous duties. For gauging time, the time log graph further comprises a multiplicity of columns with vertically aligned tick marks depicted thereon. Each tick mark corresponds to a specific time within a twenty-four hour period. A beeper is positioned within the housing for producing an audio signal upon the actuation thereof. To allow data entry, an alphanumeric keypad is situated on the top surface of the lower portion of the housing. The keypad is adapted to allow the entry and depiction via the display of a name of a driver, an address of an office for which the driver works, an address of the home terminal of the driver, and a vehicle identification number corresponding to a truck of the driver. A light is situated on the top surface of the lower portion of the housing adjacent to the keypad for allowing the entry of characters in the absence of ambient light. A portable printer is adapted to receive and couple with the housing and further produce a hard copy of the information depicted on the display. Also included are a miles in key for entering and displaying a mileage of the truck at the beginning of the day and a miles out key for entering and displaying a mileage of the truck at the end of the day. Further situated on the top surface of the lower portion of the housing is a plurality of duty buttons. The duty buttons comprise an off duty key, sleep berth key, driving key, on duty key, and miscellaneous key. Each duty button is adapted to graph a line within the corresponding row between two of the tick marks thus displaying the specific time of the day allotted thereto. The beginning of the specific line in a row is generated merely by pressing the corresponding key at the beginning of the time allotted to a particular duty. Further, the end of each line is afforded by the subsequent depression of a different duty key. Finally, a control mechanism is situated within the interior space of the lower portion of the housing. The control mechanism is adapted to automatically calculate and display the time graphically depicted for each duty, to automatically calculate and display a running weekly total of time entered during a present week for each duty, and to actuate the beeper at an end of a current day.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved trucker driver logging device which has all the advantages of the prior art log devices and none of the disadvantages.

It is another object of the present invention to provide a new and improved trucker driver logging device which may be easily and efficiently manufactured and marketed.

It is a further object of the present invention to provide a new and improved trucker driver logging device which is of a durable and reliable construction.

An even further object of the present invention is to provide a new and improved trucker driver logging device which is susceptible of a low cost of manufacture with regard to both materials and labor, and which accordingly is then susceptible of low prices of sale to the consuming public, thereby making such trucker driver logging device economically available to the buying public.

Still yet another object of the present invention is to provide a new and improved trucker driver logging device which provides in the apparatuses and methods of the prior art some of the advantages thereof, while simultaneously overcoming some of the disadvantages normally associated therewith.

Still another object of the present invention is to allow a truck driver to conveniently keep a daily log with minimal keystrokes.

Lastly, it is an object of the present invention to provide a new and improved truck driver logging device including a display adapted to depict a time log graph. The time log graph comprises a plurality of rows each corresponding to a duty pertinent to the daily activities of a truck driver. The time log graph further comprises a multiplicity of columns with vertically aligned tick marks depicted thereon. Each tick mark corresponds to a specific time within a twenty-four hour period. A plurality of duty buttons are adapted to graph a line within the corresponding row between two of the tick marks thus displaying the specific time of the day allotted to the corresponding duty. The beginning of a specific line in a row is defined merely by pressing duty key at the beginning of the time allotted to the associated duty and the end thereof is afforded by the subsequent depression of a different duty key. A control mechanism is adapted to automatically calculate and display the time graphically depicted for each duty and further to automatically calculate and display a running weekly total of time entered during a present week for each duty.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
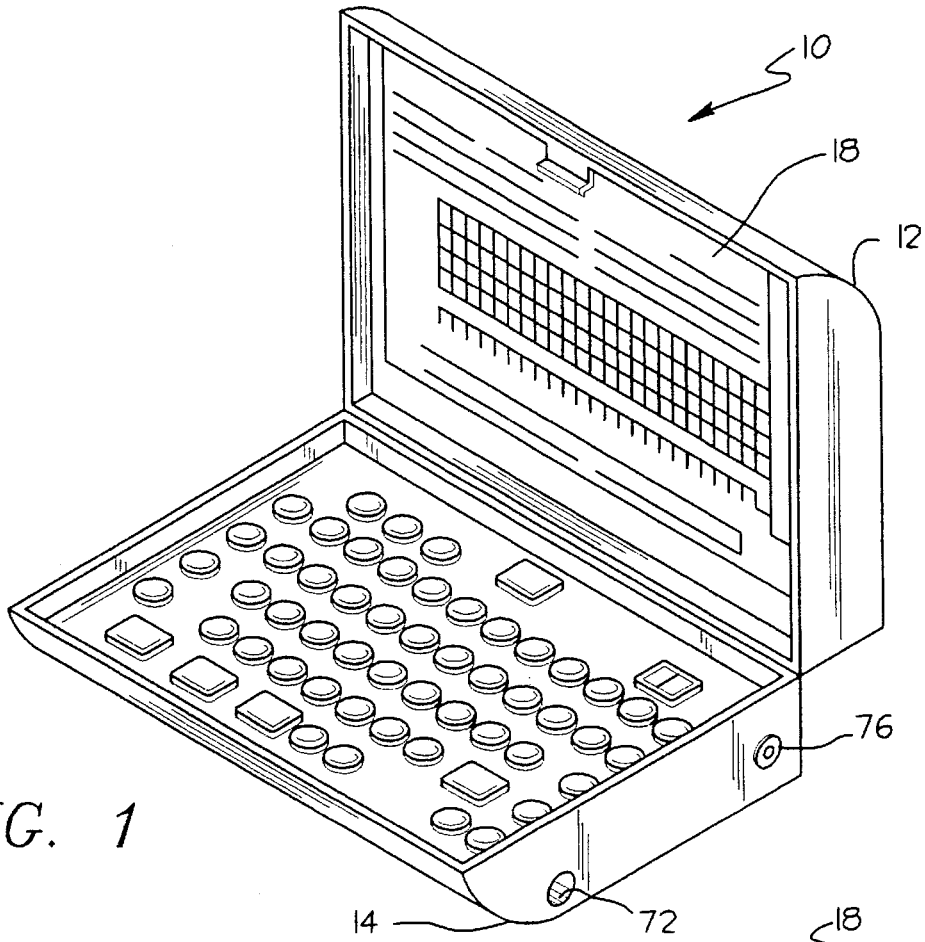
FIG. 1 is a perspective illustration of the preferred embodiment of the trucker driver logging device constructed in accordance with the principles of the present invention.
Figure 2:
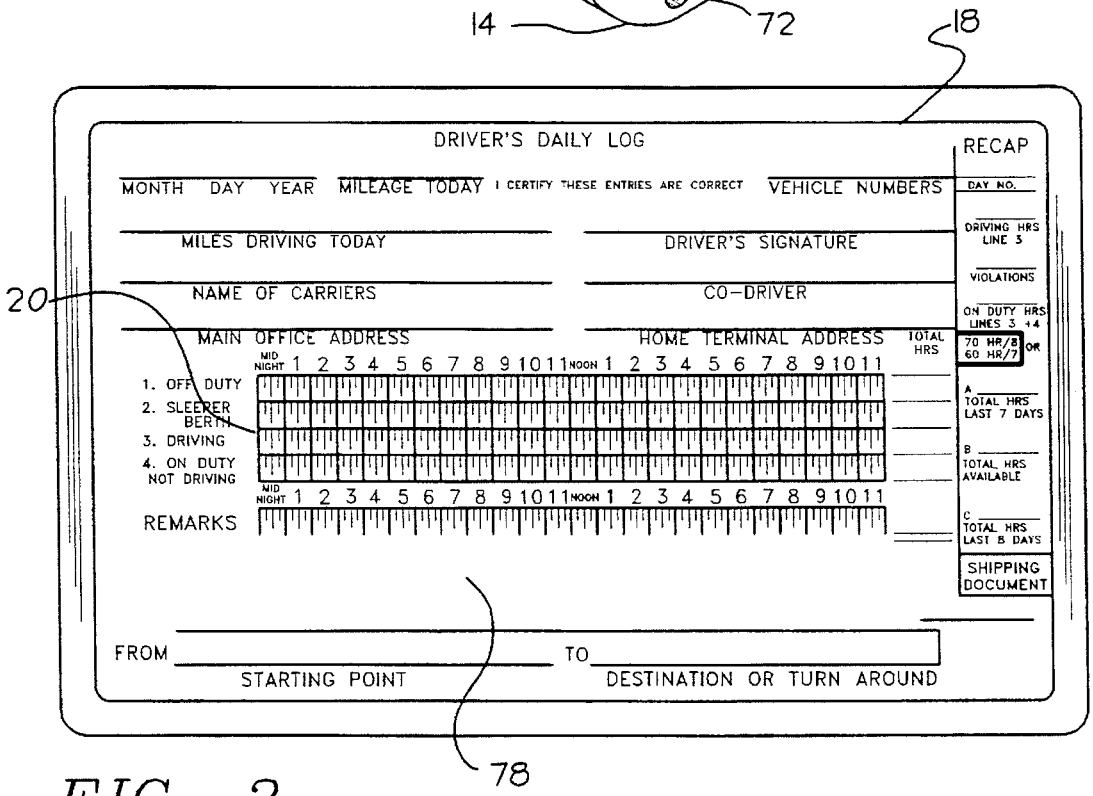
FIG. 2 is a plan front view of the layout of the display.
Figure 3:
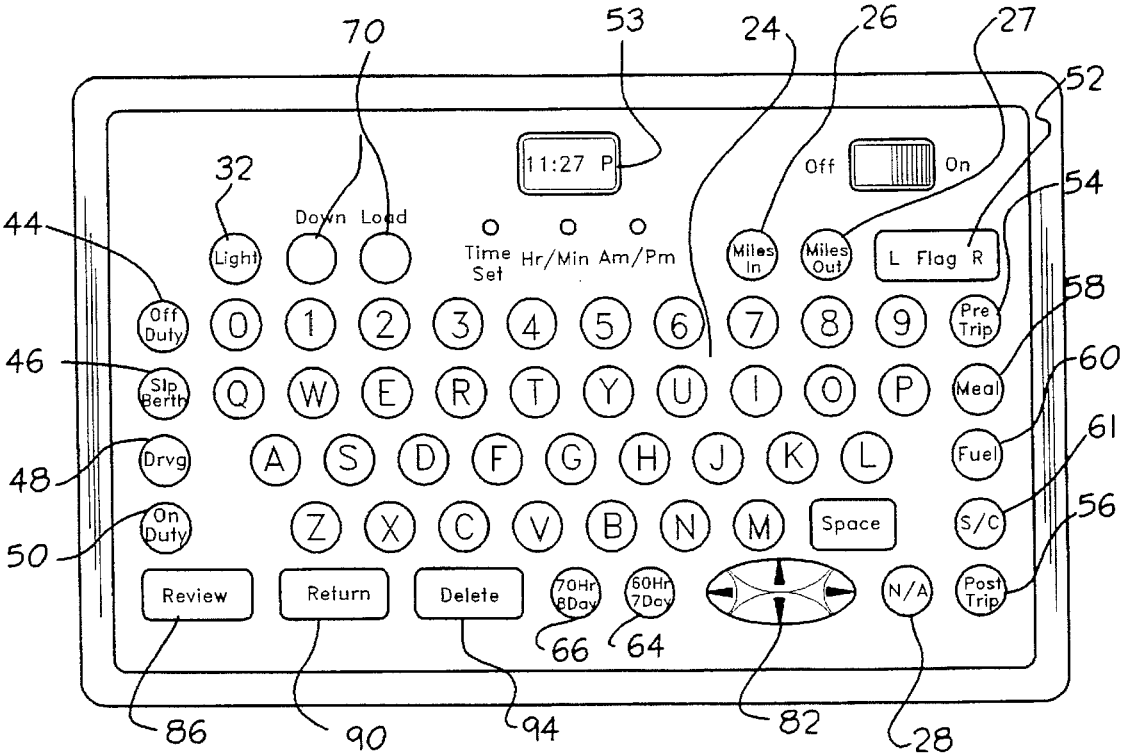
FIG. 3 is a plan view of the top surface of the lower portion and the keys associated therewith.
Figure 4:
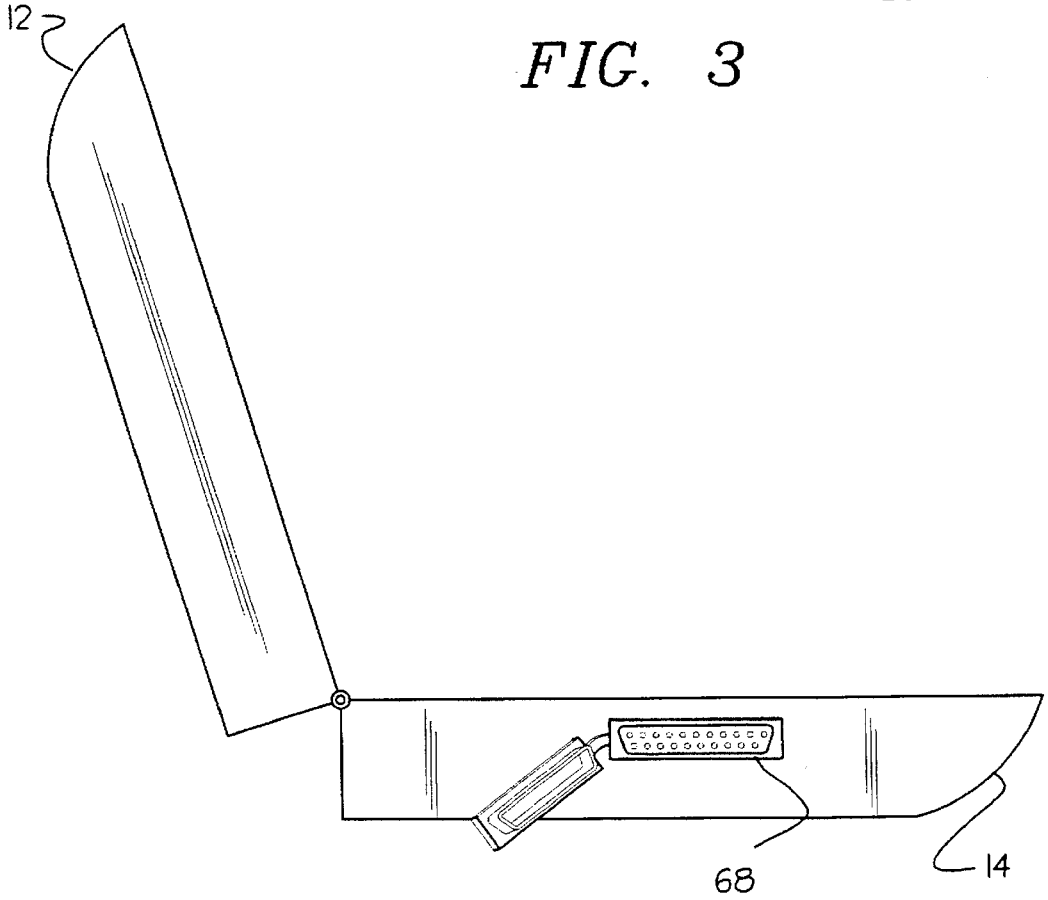
FIG. 4 is a plan side view of the housing and associated parallel port.
Figure 5:
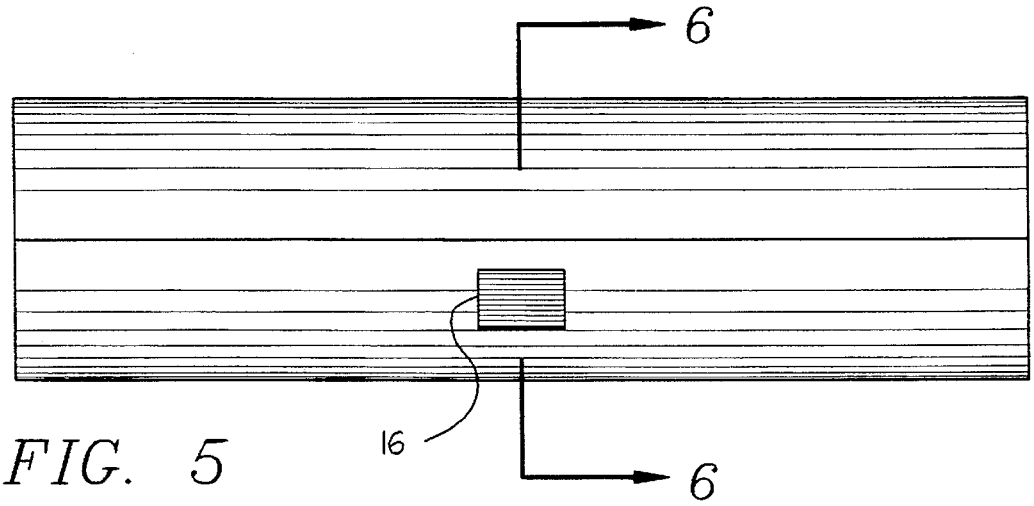
FIG. 5 is a plan view of the latching mechanism of the present invention.
Figure 6:
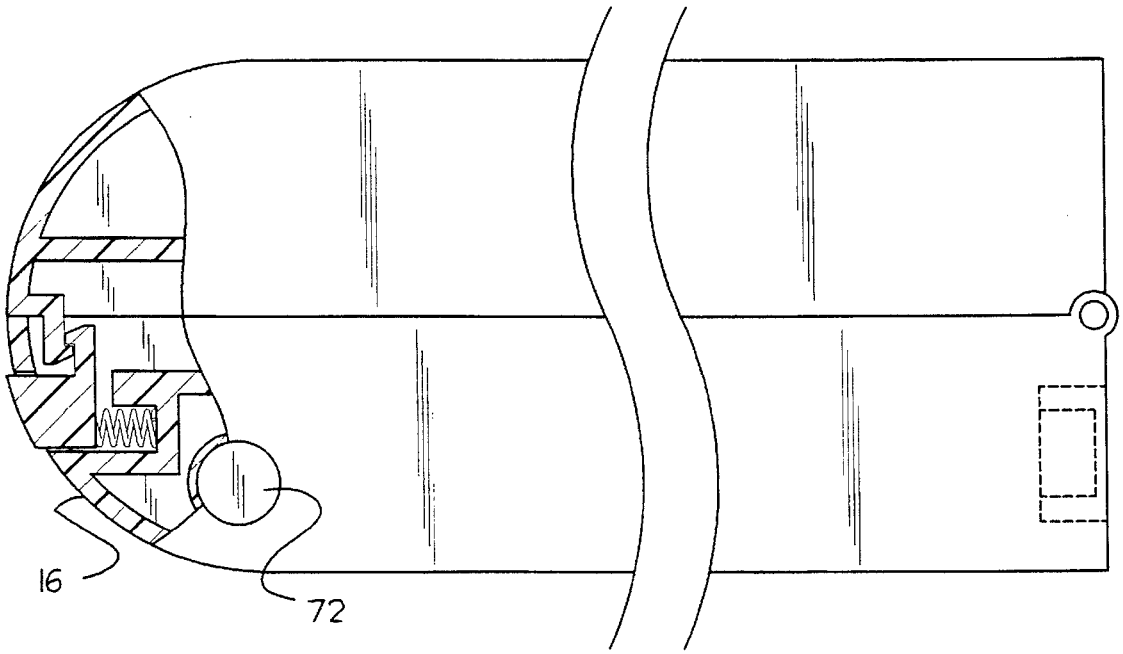
FIG. 6 is a cross-sectional view taken along line 6—6 shown in FIG. 5.
Figure 7:
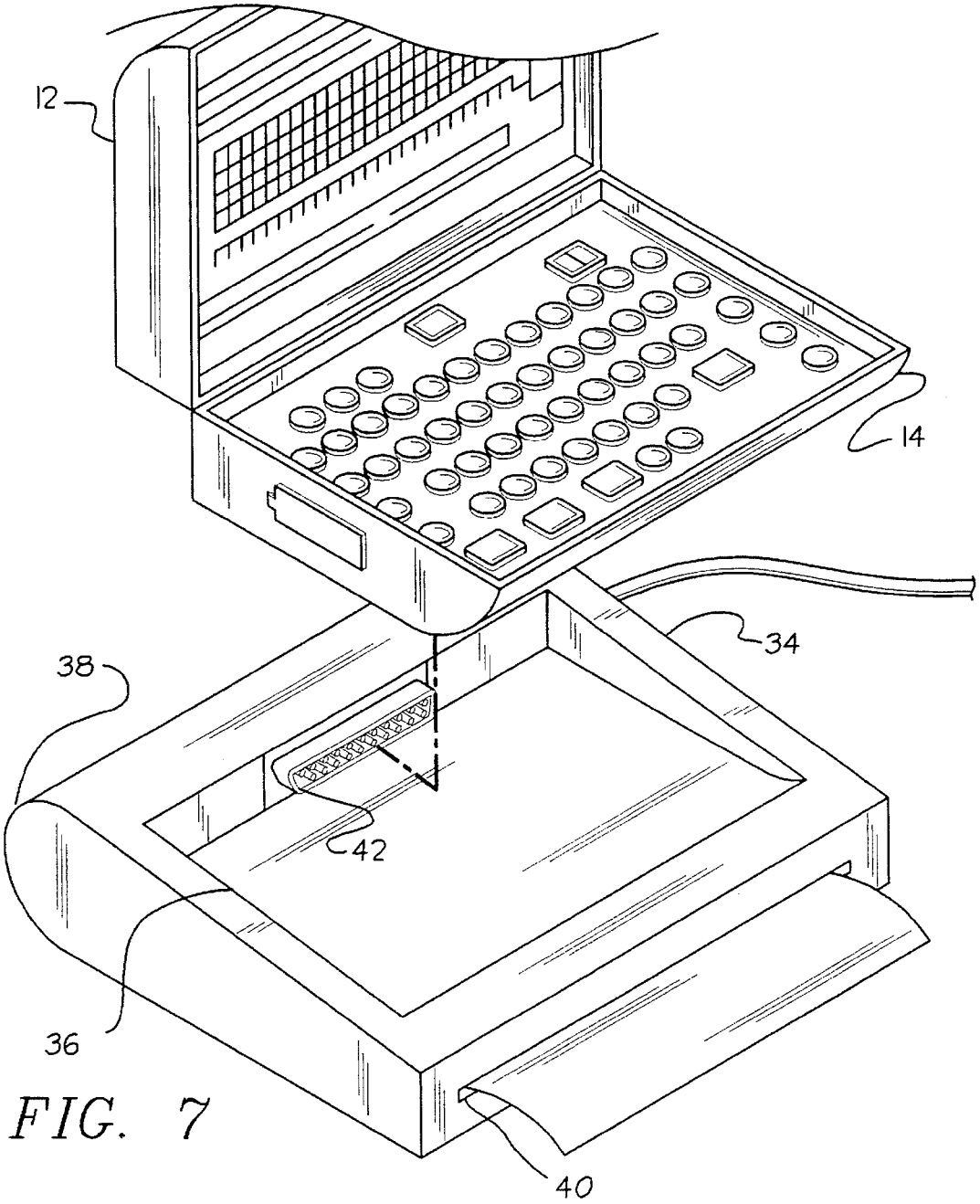
FIG. 7 is a perspective view of the present invention illustrating the coupling of the housing to the printer.
Figure 8:
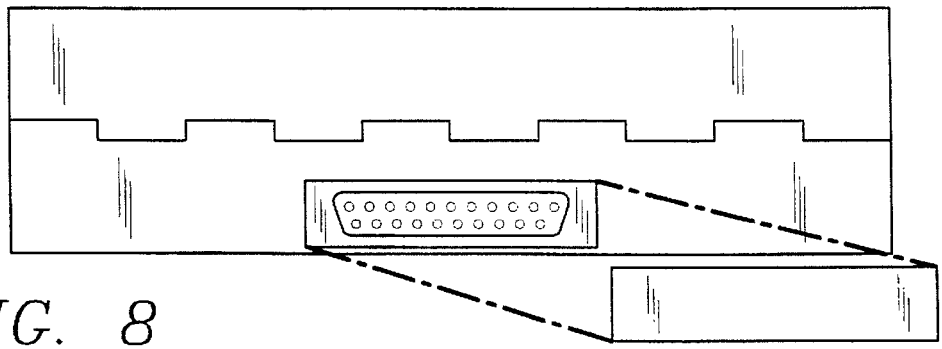
FIG. 8 is a front view of the parallel port of the printer of the present invention.
Figure 9:
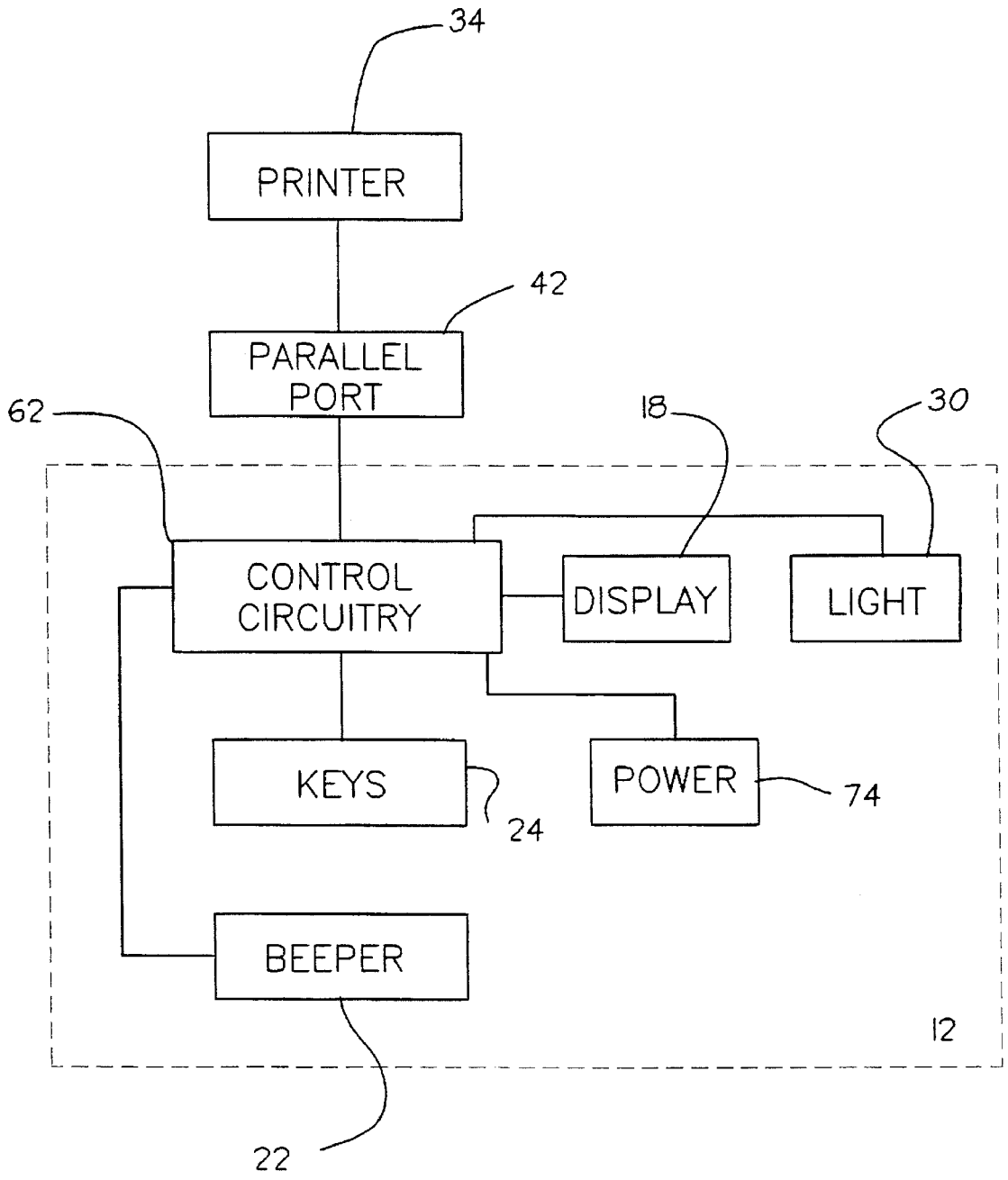
FIG. 9 is a schematical diagram of the preferred embodiment of the present invention.

With reference now to the drawings, and in particular to FIG. 1 thereof, a new and improved trucker driver logging device embodying the principles and concepts of the present invention and generally designated by the reference numeral 10 will be described.

The present invention, the new and improved trucker driver logging device, is comprised of a plurality of components. Such components in their broadest context include a housing, display, beeper, alphanumeric keypad, light, printer, duty keys, and control mechanism. Such components are individually configured and correlated with respect to each other so as to attain the desired objective.

More specifically, it will be noted that the system 10 of the present invention includes a compact housing 12 having a lower portion with a top surface, a bottom surface, and a periphery with an arcuate front edge 14 formed therebetween defining an interior space. An upper portion with a top surface, a bottom surface, and a periphery is hingably coupled to a rear extent of the lower portion for allowing the housing to be orientated in either a closed or open configuration. Included for maintaining the housing in a closed orientation is a spring loaded latching mechanism 16 situated on the periphery thereof.

Also included is a display 18 situated on the bottom surface of the upper portion. The display is adapted to depict data pertinent to truck driving and further to display a time log graph 20. The time log graph comprises a plurality of rows which include an off duty row for graphically displaying a time allotted to being off duty, a sleeper berth row for graphically displaying a time allotted to bathing and sleeping, a driving row for graphically displaying a time allotted to driving, an on duty row for graphically displaying a time allotted to not driving, and a miscellaneous row for graphically displaying a time allotted to miscellaneous duties. For gauging time, the time log graph further comprises a multiplicity of columns with vertically aligned tick marks depicted therein. Each tick mark corresponds to a specific time within a twenty-four hour period.

A beeper 22 is positioned within the housing for producing an audio signal upon the actuation thereof.

To allow data entry, an alphanumeric keypad 24 is situated on the top surface of the lower portion of the housing. The keypad is adapted to allow the entry and depiction via the display of a name of a driver, an address of an office for which the driver works, an address of the home terminal of the driver, and a vehicle identification number corresponding to a truck of the driver.

A light 30 is situated on the top surface of the lower portion of the housing adjacent to the keypad for allowing the entry of characters at night. Actuation of the light is effected via the depression of a light button 32.

A portable printer 34 is included with a top surface, a bottom surface, a front face, an arcuate rear face 38, and a pair of side edges defining an interior space. A generally rectangular recess 36 with an arcuate front portion is included for releasably receiving and coupling with the compact housing 12 wherein the arcuate front portion of the printer mates with that of the lower portion of the housing. The printer is further adapted to produce a hard copy of the information depicted on the display via a slit 40 situated on the front face thereof. Coupling with the compact housing 12 is faciliated by a parrallel port 42 situated on a rear portion of the recess 36. Preferably, a thermal tape printer is employed for the purpose of printing the hard copies of the log.

Further situated on the top surface of the lower portion of the housing is a plurality of duty buttons. The duty buttons comprise an off duty key 44, sleep berth key 46, driving key 48, on duty key 50, and miscellaneous flag key 52. Each duty button is adapted to graph a line within the corresponding row between two of the tick marks thus displaying the specific time of the day allotted to the duty associated therewith. A clock unit 53 is included which both tracks and displays time for aiding the graphing of the line. The beginning of the specific line in a row is generated merely by pressing the corresponding key at the beginning of the time allotted to the duty. Further, the end of each line is afforded by the subsequent depression of a different duty key. The miscellaneous flag key is adapted to allow the entry of a label adjacent to a specific line in the miscellaneous row via either the keyboard or a hot key. Such hot keys include a pre-trip key 54, post-trip key 56, meal key 58, fuel 60, and safety key 61 for entering a corresponding string adjacent to the specific line upon the depression thereof.

Finally, a control mechanism 62 is situated within the interior space of the lower portion of the housing. The control mechanism is adapted to automatically calculate and display the time graphically depicted for each duty, to automatically calculate and display a running weekly total of time entered during a present week for each duty, and to actuate the beeper at an end of a current day. The control mechanism has a first mode actuated by the depression of a 60 hr/7 day key 64 wherein the control mechanism is adapted to automatically calculate and display a running 7-day total of time entered as being on duty. A second mode is actuated by the depression of a 70 hr/8 day key 66 whereby the control mechanism is adapted to automatically calculate and display a running 8-day total of time entered as being on duty.

A computer link adaptor in the form of a parallel port 68 is included for down loading past information to a conventional computer. Downloading may be afforded by connecting the present invention with a conventional computer and subsequently depressing the download keys 70. The device also includes a light pen 72 adapted to allow the user to provide a signature on each daily log as required by law. A long-life rechargeable battery 74 is provided to power the unit with an associated 12-volt adaptor 76 for operating and recharging the unit in the truck.

In use, the truck driver logging device is an apparatus which may be conveniently operated by a truck driver while driving. Once the time and date have been set, these and other information such as carrier name, office address, co-driver, home terminal address and vehicle numbers, upon being entered via the keypad, will be automatically transferred by the control mechanism from day to day unless the user acts to change them. Seeing as how most drivers work for the same company every day, such a feature affords a great time saving asset. The duty hours may be recorded on the graph by simply pushing the button that corresponds to the user's activity. The device will automatically record the entry on the graph via a line displayed in the corresponding row until the user presses another button. Once the work day has ended, the control mechanism automatically calculates the total hours in each category and displays each total accordingly.

Since the device cannot read the odometer of the truck, the mileage entries must be entered by the operator. This entry may be performed with a miles in key 26 and a miles out key 27. At the beginning of the day, the user may push the miles in key and enter the odometer reading via the alphanumeric keypad. At the end of day, a similar method is employed for entering the miles out. Upon the entry of the ending mileage, the device automatically calculates and displays the correct mileage. Team drivers can enter the beginning and ending mileage off and on all day since the control mechanism is adapted to calculate a correct daily total regardless of the amount of entries that have been made. The driver may also choose the 70 hr/8 day or 60 hr/7 day entries by simply pushing the appropriate button. The unit will respond and record information accordingly. In a remarks section 78, labels consisting of vertical lines or flags are drawn connected to a specific tick mark line so as to identify the user's miscellaneous actions. These lines are labeled to show where the driver was and what he was doing at the specific time during the day. The device provides a series of hot keys for such entries. The miscellaneous flag key is a toggle button which is included for use with such hot keys. Once pushed, it enters a line at the corresponding time. The button has a left and right side for writing on either side of the line. Several hot key representing common entries have been provided, such as pre-trip, post-trip, meal, fuel and s/c (safety check). The left side of the line is used to display what the driver was doing at the specified time. The right side of the line is for depicting where the driver was at the specified time. The entries on the right side must be entered with the keypad (i.e., city and state). Also included is a not applicable key 28 to be used for such things as having no co-driver, being off duty and having no start point and destination. The not applicable key is included since the law requires that every line of a daily log have an entry and that nothing be left blank. Further included is a 4-way cursor button 82 for moving from line to line to efficiently make entries. The unit is equipped with enough memory to store a month worth of entries. Since an officer of the law can request to see prior logs, the unit has a review and return set of buttons. Upon the depression of a review key 86, the display shows the previous day. To inspect a subsequent day, the return button 90 must be depressed. There is also a delete button 94 included in case a wrong entry is made. A user may use the cursor, review and return buttons to locate any erroneous data so that it may be corrected.

Today, almost every business keeps records on computer files. The trucker driver logging device eliminates the need for space to store hard copies of drivers log record, which in a large company could require a lot of space. The trucker driver logging device eliminates messy or illegible entries and gives the driver more time for other duties, such as sleeping or checking the truck and its load. The trucker driver logging device does away with the need for other tools such as pens and rulers which can easily become lost or dropped. The user won't have to fumble with getting the carbon paper in place with the present invention. The trucker driver logging device, when closed, is its own carrying case where as the prior paper log needs a carrying case to house it and the tools associated therewith.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved trucker driver logging device comprising, in combination:

a compact housing having a lower portion with a top surface, a bottom surface, and a periphery formed therebetween defining an interior space and further having an upper portion with a top surface, a bottom surface, and a periphery hingably coupled to a rear extent of the lower portion;

a display situated on the bottom surface of the upper portion, the display adapted to depict data pertinent to truck driving and further to display a time log graph, the time log graph comprising a plurality of rows, the rows including an off duty row for graphically displaying a time allotted to being off duty, a sleeper berth row for graphically displaying a time allotted to bathing and sleeping, a driving row for graphically displaying a time allotted to driving, an on duty row for graphically displaying a time allotted to not driving, and a miscellaneous row for graphically displaying a time allotted to miscellaneous duties, the time log graph further comprising a multiplicity of columns with vertically aligned tick marks depicted therein, each tick mark corresponding to a specific time within a twenty-four hour period;

a beeper positioned within the housing for producing an audio signal upon the actuation thereof;

an alphanumeric keypad situated on the top surface of the lower portion of the housing and adapted to allow the entry and depiction via the display of a name of a driver, an address of an office for which the driver works, an address of the home terminal of the driver, and a vehicle identification number corresponding to a truck of the driver;

a lighting means situated on the top surface of the lower portion of the housing adjacent to the keypad for allowing the entry of characters in the absence of ambient light;

a portable printer means with a top surface, a bottom surface, a front face, an arcuate rear face, and a pair of side edges defining an interior space, the portable printer means further including a generally rectangular recess for releasably receiving and coupling with the compact housing, the printer means further adapted to produce a hard copy of the information depicted on the display via a slit situated on the front face thereof, wherein coupling with the compact housing is faciliated by a parrallel port situated on a rear portion of the recess;

a pair of mile entry keys including a miles in key for entering and displaying a mileage of the truck at the beginning of the day and a miles out key for entering and displaying a mileage of the truck at the end of the day;

a plurality of duty buttons situated on the top surface of the lower portion of the housing, the duty buttons comprising an off duty key, sleep berth key, driving key, on duty key, and miscellaneous key, the duty buttons adapted to graph a line within the corresponding row between two of the tick marks thus displaying the specific time of the day allotted to the corresponding duty, whereby a beginning of the specific line in a row is generated merely by pressing the corresponding key at the beginning of the time allotted thereto and the end thereof is afforded by the subsequent depression of a different duty key; and control means situated within the interior space of the lower portion of the housing and adapted to keep a current date and a current time, to automatically calculate and display the time graphically depicted for each duty, to automatically calculate and display a running weekly total of time entered during a present week for each duty, and to actuate the beeper at an end of a current day.

2. A trucker driver logging device comprising:

a display adapted to depict a time log graph, the time log graph comprising a plurality of rows each corresponding to a plurality of various duties pertinent to truck driving, the time log graph further comprising a multiplicity of columns with vertically aligned tick marks depicted therein, each tick mark corresponding to a specific time within a twenty-four hour period;

a plurality of duty buttons adapted to graph a line within the corresponding row between two of the tick marks thus displaying the specific time of the day allotted to the corresponding function, whereby a beginning of a specific line in a row is defined merely by pressing the corresponding key at the beginning of the time allotted and the end thereof is afforded by the subsequent depression of a different duty key; and control means adapted to keep a current date and a current time, to automatically calculate and display the time graphically depicted for each duty, and to automatically calculate and display a running weekly total of time entered during a present week for each duty.

3. A trucker driver logging device as set forth in claim 2 and further comprising an alphanumeric keypad situated on the top surface of the lower portion of the housing and adapted to allow the entry and depiction via the display of a name of a driver, an address of an office for which the driver works, an address of the home terminal of the driver, and a vehicle identification number corresponding to a truck of the driver.

4. A trucker driver logging device as set forth in claim 2 and further comprising a beeper for producing an audio signal upon the actuation thereof, wherein the control means is further adapted to actuate the beeper at an end of a current day.

5. A trucker driver logging device as set forth in claim 2 and further comprising a compact housing having a lower portion with a top surface, a bottom surface, and a periphery formed therebetween defining an interior space and further having an upper portion with a top surface, a bottom surface, and a periphery hingably coupled to a rear extent of the lower portion.

6. A trucker driver logging device as set forth in claim 2 and further comprising lighting means for allowing the use of the present invention in the abscence of ambient light.

7. A trucker driver logging device as set forth in claim 2 wherein the control means has a first mode actuated by the depression of a first key whereby the control means is adapted to automatically calculate and display a running 7-day total of time entered which represents time that the driver was on duty and driving and a second mode actuated by the depression of a second key whereby the control means is adapted to automatically calculate and display a running 8-day total of time entered which represents time that the driver was on duty and driving.

8. A trucker driver logging device as set forth in claim 2 and further comprising a portable printer means with a top surface, a bottom surface, a front face, an arcuate rear face, and a pair of side edges defining an interior space, the portable printer means further including a generally rectangular recess for releasably receiving and coupling with the compact housing, the printer means further adapted to produce a hard copy of the information depicted on the display via a slit situated on the front face thereof, wherein coupling with the compact housing is faciliated by a parrallel port situated on a rear portion of the recess.

9. A trucker driver logging device as set forth in claim 2 wherein the duties include being off duty, bathing and sleeping, driving, not driving, and performing miscellaneous duties.

10. A trucker driver logging device as set forth in claim 9 and further comprising a miscellaneous flag key, the miscellaneous flag key adapted to allow the entry via an input means a note associated with the line entered via a key corresponding to a miscellaneous duty.

11. A trucker driver logging device as set forth in claim 10 wherein the input means comprises a keypad.

12. A trucker driver logging device as set forth in claim 10 wherein the input means comprises a plurality of hot keys each adapted to display a corresponding predetermined string upon the depression thereof.

13. A trucker driver logging device as set forth in claim 2 and further including a miles in key for entering and displaying a mileage of the truck at the beginning of the day and a miles out key for entering and displaying a mileage of the truck at the end of the day.

* * * * *